US009387687B2

(12) United States Patent
Yoshizawa et al.

(10) Patent No.: US 9,387,687 B2
(45) Date of Patent: Jul. 12, 2016

(54) IMAGE FORMING DEVICE AND IMAGE FORMING METHOD

(71) Applicants: CITIZEN HOLDINGS CO., LTD., Tokyo (JP); CITIZEN SYSTEMS JAPAN CO., LTD., Tokyo (JP)

(72) Inventors: Masao Yoshizawa, Nagano (JP); Hirotaka Kamiya, Nagano (JP); Keiji Matsumura, Nagano (JP)

(73) Assignees: CITIZEN HOLDINGS CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 14/429,335

(22) PCT Filed: May 8, 2014

(86) PCT No.: PCT/JP2014/062349
§ 371 (c)(1),
(2) Date: Mar. 18, 2015

(87) PCT Pub. No.: WO2014/208203
PCT Pub. Date: Dec. 31, 2014

(65) Prior Publication Data

US 2015/0239257 A1 Aug. 27, 2015

(30) Foreign Application Priority Data

Jun. 28, 2013 (JP) ..... 2013-136910

(51) Int. Cl.
*B41J 17/36* (2006.01)
*B41J 2/325* (2006.01)
(Continued)

(52) U.S. Cl.
CPC *B41J 2/325* (2013.01); *B41J 17/10* (2013.01); *B41J 17/12* (2013.01); *B41J 17/14* (2013.01); *B41J 17/32* (2013.01); *B41J 33/44* (2013.01); *B41J 33/54* (2013.01)

(58) Field of Classification Search
USPC ..... 400/249; 347/171
See application file for complete search history.

(56) References Cited

U.S. PATENT DOCUMENTS 5,501,537 A * 3/1996 Kohno ..... B41J 35/18 347/177
5,567,066 A * 10/1996 Paranjpe ..... 400/249
(Continued)

FOREIGN PATENT DOCUMENTS

JP H01-291977 A 11/1989
JP H04-148944 A 5/1992
(Continued)

OTHER PUBLICATIONS

International Search Report for PCT/JP2014/062349, Aug. 5, 2014.
(Continued)

*Primary Examiner* — Matthew Luu
*Assistant Examiner* — Lily Kemathe

(57) ABSTRACT

An image forming device and method are provided which reduce erroneous detection of a border between transfer material areas when forming a new image by using unused portions of partially used transfer material areas. The image forming device forms an image having a first size or a second size which is one-half of the first size or smaller on a recording medium by transferring transfer materials respectively for transfer material areas, while feeding a strip-shaped transfer medium on which the transfer material areas each having the first size and respectively corresponding to the transfer materials are repeatedly arranged in a predetermined sequence in the longitudinal direction thereof. The transfer medium is fed in a forward direction until an unused portion of a subsequent transfer material area adjacent to a used portion of a transfer material area reaches the detection position and thereafter fed in the reverse direction, so that the border between the used and unused portions is detected from the unused portion side, when a second-size image is newly formed by using unused portions in the respective transfer material areas having been used to form a second-size image.

3 Claims, 6 Drawing Sheets

(51) Int. Cl.

| | |
|---|---|
| ***B41J 17/12*** | (2006.01) |
| ***B41J 17/14*** | (2006.01) |
| ***B41J 17/10*** | (2006.01) |
| ***B41J 17/32*** | (2006.01) |
| ***B41J 33/54*** | (2006.01) |
| ***B41J 33/44*** | (2006.01) |

(56) References Cited

U.S. PATENT DOCUMENTS

| | | | | |
|---|---|---|---|---|
| 6,412,991 | B1 * | 7/2002 | Klinefelter | B41J 17/36 347/177 |
| 7,397,489 | B2 * | 7/2008 | Mindler et al. | 347/176 |
| 7,553,096 | B2 * | 6/2009 | Mindler | 400/240 |
| 2006/0181597 | A1 * | 8/2006 | Mindler | 347/171 |
| 2007/0041764 | A1 * | 2/2007 | Pareigis et al. | 399/401 |

FOREIGN PATENT DOCUMENTS

| | | | |
|---|---|---|---|
| JP | H04-348982 | A | 12/1992 |
| JP | H06-143720 | A | 5/1994 |
| JP | H11-245493 | A | 9/1999 |
| JP | 2001-246823 | A | 9/2001 |
| JP | 2004-202941 | A | 7/2004 |
| JP | 2007-196575 | A | 8/2007 |

OTHER PUBLICATIONS

Written Opinion of the International Searching Authority for PCT/JP2014/062349, Aug. 5, 2014.

* cited by examiner

IMAGE FORMING DEVICE AND IMAGE FORMING METHOD

TECHNICAL FIELD

This invention relates to an image forming device and an image forming method.

BACKGROUND ART

An image forming device is known which forms an image on a recording medium by transferring transfer materials respectively for a plurality of transfer material areas repeatedly arranged in the longitudinal direction of a strip-shaped transfer medium. Specifically, an image forming device is known which partially uses the transfer material areas to form an image having a size not more than one-half of a transfer material area, and thereafter rewinds the transfer medium, and then uses unused portions of the partially used transfer material areas to form a new image having the same size.

Patent Literature 1 describes a thermal transfer color printer which uses, when performing L-size printing by using an ink ribbon corresponding to 2L-size, the rear part of each ink area of the ink ribbon (rewinding direction of the ink ribbon) prior to the front part (winding direction of the ink ribbon) thereof which is normally considered to be used prior to the rear part. With this printer, if L-size printing is performed in two steps, when the ink ribbon which has been used to print the first sheet is rewound and reused, the second sheet can be printed without being affected by creases formed in the portion of the ink ribbon where the ink has been exhausted.

Patent Literature 2 describes a thermal transfer recording device for transfer-recording an image on a recording sheet by using an ink sheet corresponding to an A4 size recording sheet and including dye portions for different colors. This thermal transfer recording device includes a counter to count the number of recorded sheets up to the present time in an A5 size recording mode, and in the case of a continual recording on a A5 size recording sheet, when the number of the sheets counted by the counter is an odd number, the transfer recording of each color is conducted in the same way as A4 size recording, and when the number of the sheets counted by the counter is an even number, the transfer recording of each color is conducted while the ink sheet is rewound by driving a rewinding motor.

Patent Literature 3 describes a transfer method in a recording device which superimposes and transfers different color inks onto a recording sheet from an ink sheet having a plurality of color inks successively applied thereon in the feeding direction. With this transfer method, if an image is transferred onto a recording sheet whose surface area is approximately one-half of each surface area of the ink sheet that has been coated with an ink, front halves of respective color ink-applied areas are used to transfer an image, thereafter, the ink sheet is rewound to a portion where the rear halves of the ink-applied areas can be transferred, and another image is transferred by using the rear halves of the ink sheet.

A transfer medium provided with a marking such as a black borderline which is used to detect a border between transfer material areas is known. However, transfer media without such markings are more commonly used, in order to provide as large transfer material areas as possible. In response to such transfer media, an image forming device is provided with a detection unit which detects the border between the transfer material areas based on a change of the colors of the transfer material areas that are fed and pass the detection position.

CITATION LIST

Patent Literature

Patent Literature 1: Japanese Patent Application Laid-open Publication No. 2004-202941

Patent Literature 2: Japanese Patent Application Laid-open Publication No. H06-143720

Patent Literature 3: Japanese Patent Application Laid-open Publication No. H04-148944

SUMMARY OF INVENTION

When a new image is formed by using unused portions of partially used transfer material areas, a border between the used portion of one transfer material area and the unused portion of the subsequent transfer material area may be detected. However, if a border between the used portion in which the transfer material has been exhausted in the previous image forming and the unused portion on which the transfer material remains is detected by a detection unit which detects the border between the transfer material areas based on the color change between the transfer material areas, erroneous detection may occur due to the unstable detection level.

Therefore, an object of the present invention is to reduce the possibility of erroneous detection of a border between transfer material areas when forming a new image by using unused portions of partially used transfer material areas, compared with a device which does not have the constituent features of the present invention.

Provided is an image forming device including a feeding unit to feed a strip-shaped transfer medium on which a plurality of transfer material areas each having a first size and respectively corresponding to a plurality of transfer materials are repeatedly arranged in a predetermined sequence in the longitudinal direction of the transfer medium, an image forming unit to form an image having the first size or a second size which is not more than one-half of the first size on a recording medium by transferring the transfer materials respectively for the transfer material areas, a detection unit to detect a border between the transfer material areas based on a change of colors of the transfer material areas which are fed by the feeding unit and pass through a detection position, and a control unit to control the feeding unit to feed the transfer medium in a forward direction until an unused portion of a subsequent transfer material area adjacent to a used portion of a transfer material area reaches the detection position and thereafter to feed the transfer medium in the reverse direction, so that the detection unit detects the border between the used portion and the unused portion from the unused portion side, when an image of the second size is newly formed by the image forming unit by using unused portions included in the respective transfer material areas which have been used to form an image of the second size.

Preferably, in the image forming device, when an image of the second size is formed by using unused transfer material areas, the image forming unit uses rear halves of the respective transfer material areas in the forward direction, and the used portion is the rear half of the transfer material area in the forward direction, and the unused portion is the front half of the transfer material area in the forward direction.

Additionally, provided is an image forming method to form an image having a first size or a second size which is not more than one-half of the first size on a recording medium by transferring a plurality of transfer materials respectively for a plurality of transfer material areas, while feeding a strip-shaped transfer medium on which the transfer material areas each having the first size and respectively corresponding to the transfer materials are repeatedly arranged in a predetermined sequence in the longitudinal direction of the transfer medium. The method includes the steps of detecting a border between the transfer material areas based on a change of colors of the transfer material areas which are fed and pass through a detection position, and controlling the transfer medium to be fed in a forward direction until an unused portion of a subsequent transfer material area adjacent to a used portion of a transfer material area reaches the detection position and thereafter fed in the reverse direction, so that the border between the used portion and the unused portion is detected from the unused portion side, when an image of the second size is newly formed by using unused portions included in the respective transfer material areas which have been used to form an image of the second size.

The above image forming device and image forming method can reduce the possibility of erroneous detection of a border between transfer material areas when forming a new image by using unused portions of partially used transfer material areas, compared with a device which does not have the constituent features of the present invention.

DESCRIPTION OF EMBODIMENTS

Hereinafter, with reference to the accompanying drawings, an image forming device and an image forming method will be explained in detail. However, it should be noted that the technical scope of the present invention is not limited to embodiments thereof and includes the invention described in claims and equivalents thereof.

Figure 1:
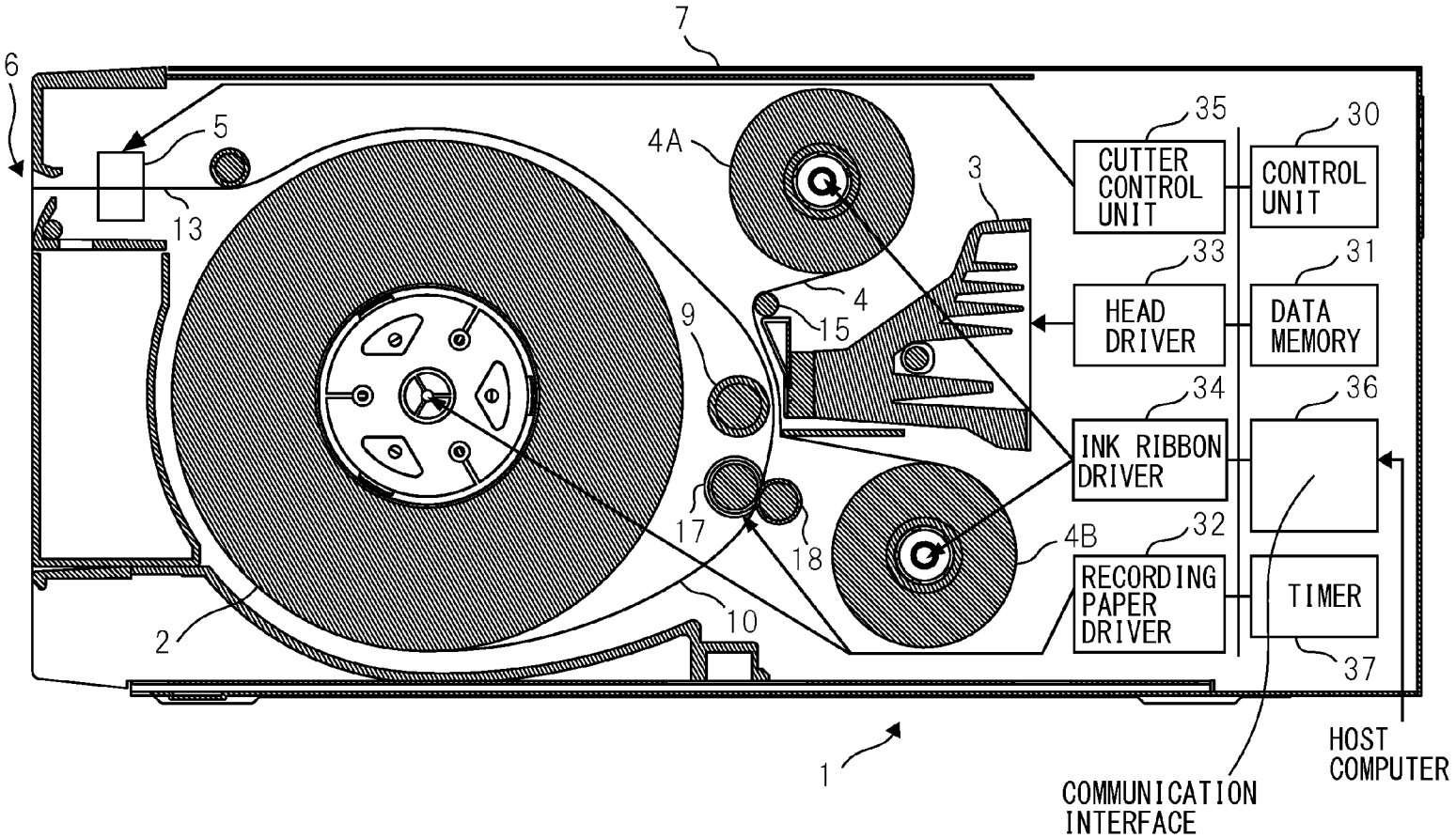
FIG. 1 schematically illustrates the structure of a printer 1.

FIG. 1 schematically illustrates the structure of a printer 1. In FIG. 1, amongst the components provided in the printer 1, only those necessary for explanation are shown and the other components are not shown.

The printer 1 (an example of the image forming device) is a printer which forms images of a plurality of colors such as yellow, magenta, and cyan, on the same sheet, by reciprocally moving a rolled recording paper (an example of the recording medium) with respect to a head, to thereby repeat a plurality of image forming processes on the recording paper. Image forming will also be referred to as "printing" hereinafter.

The printer 1 forms an image on a recording surface of a rolled recording paper 10 which is held in a rolled paper holder 2 and which is unwound from the rolled paper holder 2. The rolled recording paper 10 is held by the rolled paper holder 2, for example, with the rotational shaft of the rolled recording paper 10 being rotatably supported by the rolled paper holder 2. Thus, the recording paper 10 is rotatably housed in the rolled paper holder 2.

The image forming is performed by recording ink at a predetermined position by a head 3, while bringing an ink ribbon (an example of the transfer medium) into contact with the recording surface of the recording paper 10. During the recording process, the ink ribbon 4 and the recording paper 10 are superposed and moved to pass between the head 3 and a platen roller 9. The head 3 is configured to be movable with respect to the platen roller 9, and is pushed and pressed against the platen roller 9 when an image is formed. In the printer 1, heating elements which constitute the head 3 generate heat in a predetermined pattern, so that an image is transferred from the ink ribbon 4 onto the recording paper 10 to thereby form an image on the recording paper 10.

To form a colored image, ink areas for yellow, magenta, and cyan (examples of the transfer materials) which correspond to the colors of the image to be formed are prepared and arranged on the ink ribbon 4 sequentially in the winding direction of the ink ribbon 4, and the movement of the ink areas to pass the head 3 while winding the ink ribbon is repeated for each color. The ink ribbon 4 is fed from a feeding ribbon roller 4A and is wound around a winding ribbon roller 4B. These rollers may also be referred to as "ribbon rollers 4A, 4B" hereinafter. The ink ribbon 4 is guided by a ribbon guide roller 15 provided between the feeding ribbon roller 4A and the head 3, and a ribbon guide portion 16 (see FIG. 2A) formed integrally with the head 3.

When an image of each color is formed, the recording paper 10 is fed (unwound) by an amount corresponding to the length enough for the recording paper to pass the position of the head 3 for image forming, and is rewound thereafter. The head 3 forms the image in the process of rewinding the recording paper 10. During the image forming process, the printer 1 reciprocally moves the recording paper 10 to form the images of respective colors superimposed on the same image forming area of the recording paper 10. The reciprocal movement of the recording paper 10 is performed by a grip roller 17 and a pinch roller 18 provided on a feeding path of the recording paper 10. The rotation direction of the rolled paper holder 2 is changed by these rollers in accordance with the feeding direction of the recording paper 10 to thereby repeat the unwinding and winding of the recording paper 10. When the image forming is not performed, the pinch roller 18 is spaced from the grip roller 17 to release the recording paper 10. On the other hand, while an image is formed, the grip roller 17 and the pinch roller 18 hold and feed the recording paper 10 therebetween. Thus, the recording paper 10 is reciprocally moved with respect to the head 3, and a plurality of image forming processes on the same image forming area of the recording paper 10 are repeated.

The ink ribbon 4 includes an overcoat layer (an example of the transfer materials) in addition to the ink areas for yellow, magenta, and cyan. After the images of all colors are formed on the recording surface of the recording paper 10, the recording surface is coated with and protected by the overcoat layer.

The printer 1 also includes a recording paper cutter 5 located directly before a discharge outlet 6 and on a discharge path 13. The recording paper 10 having an image formed thereon passes the head 3, and is thereafter delivered through the discharge path 13 and discharged to the outside of the printer from the discharge outlet 6 provided for a housing 7 of the printer. The recording paper cutter 5 cuts the recording paper 10 discharged from the discharge outlet 6 at a position just before the discharge outlet 6. Consequently, the cut recording paper 10 is removed from the discharge outlet 6.

The printer 1 further includes a control unit 30, a data memory 31, a recording paper driver 32, a head driver 33, an ink ribbon driver 34, a cutter control unit 35, and a communication interface 36.

The control unit 30 generally controls the operations of the printer 1. The control unit 30 includes CPU, RAM, ROM, etc., and performs the image forming operation described later by loading and executing a program preliminarily stored in the ROM to the RAM. The data memory 31 forms a storage area to store image data received from a host computer via the communication interface 36.

The recording paper driver 32 moves the recording paper 10 pinched between the grip roller 17 and the pinch roller 18. The recording paper driver 32 feeds the recording paper 10 by rotating the grip roller 17 and the rolled paper holder 2. Moreover, the recording paper driver 32 rewinds the fed recording paper 10 by rotating the grip roller 17 and the rolled paper holder 2 in the reverse direction. The printer 1 forms an image on the recording paper 10 when the fed recording paper 10 is rewound.

The head driver 33 drives the head 3 based on the image data to form an image on the recording paper. The head 3 can be of any type of mechanism depending on various image forming methods, such as a sublimation-type printer, a thermal-fusion-type printer, etc. The printer 1 is provided with the head 3, the platen roller 9, and the head driver 33, as an example of the image forming unit to form an image on a recording medium.

The ink ribbon driver 34 drives the feeding ribbon roller 4A and the winding ribbon roller 4B to move the ink ribbon 4 with respect to the head 3, in synchronization with the operation of the head 3. The ink ribbon driver 34 also includes a rewinding mechanism of the ink ribbon 4, and is capable of driving the ink ribbon 4 in the rewinding direction, which is opposite to the winding direction (forward direction). The printer 1 is provided with the ribbon rollers 4A, 4B, and the ink ribbon driver 34, as an example of a feeding unit to feed a strip-shaped transfer medium.

The cutter control unit 35 controls the recording paper cutter 5 so that the recording paper 10 is cut off at the rear end of the recorded portion when the recording paper 10 is discharged from the discharge outlet 6 via the discharge path 13.

The communication interface 36 transmits and receives data to and from the host computer via a communication cable. A timer 37 measures an elapsed time so that when data for, for example, two images smaller than each ink area of the ink ribbon 4 is received successively from the host computer within a predetermined time, the data for the two images is allocated to the same ink area to form an image.

Figure 2A:
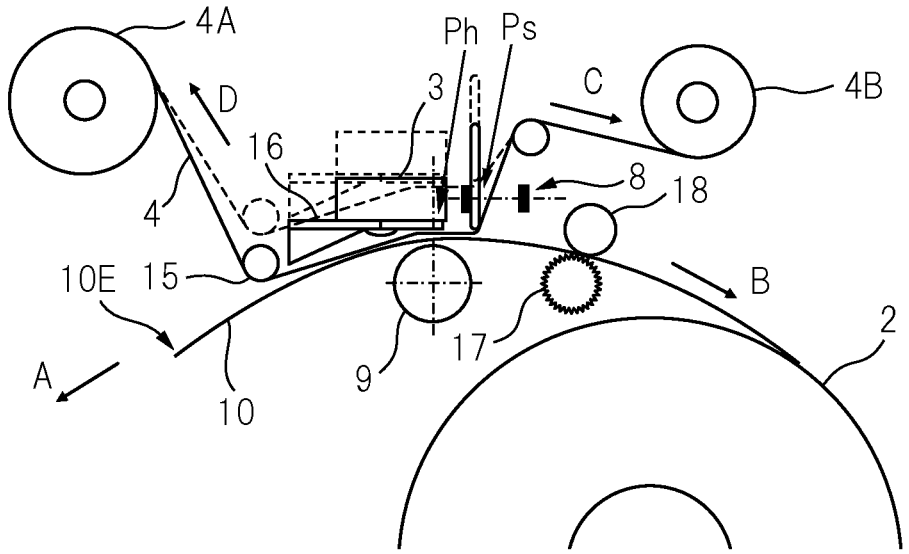
FIGS. 2A and 2B are enlarged views of the surroundings of the head 3 in FIG. 1.
Figure 2B:
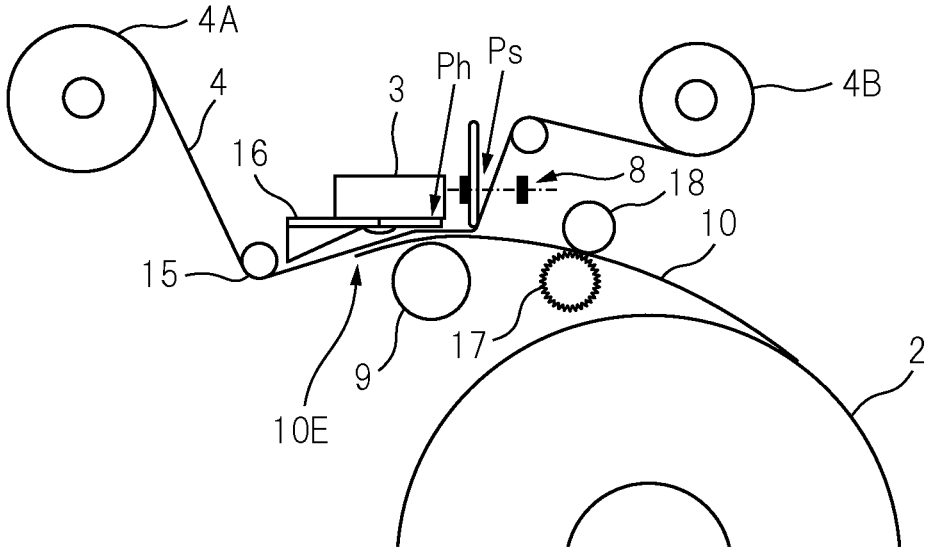

FIGS. 2A and 2B are enlarged views of the surroundings of the head 3 in FIG. 1. FIG. 2A illustrates the positional relationship between the head 3 and the recording paper 10 when the image forming for one color begins. On the other hand, FIG. 2B illustrates the positional relationship between the head 3 and the recording paper 10 when the image forming for one color ends. In FIG. 2A, the position of the head 3 which is forming an image is shown by a solid line, and the position of the head 3 which is not forming an image is shown by a dashed line.

As shown in FIG. 2A, when the image forming for one color begins, first, the recording paper 10 is fed in the direction of an arrow A by an amount corresponding to the length of the image forming area on the recording paper 10, so that an edge 10E of the recording paper 10 is moved to the left side of the drawing. For example, When the image forming for yellow begins, the front end of the ink area of yellow and the front end of the image forming area on the recording paper 10 are registered with a position Ph where the head 3 forms an image. Hereinafter, the position where the head 3 forms an image on the feeding path of the ink ribbon 4 will be referred to as the "head position Ph". With the ink ribbon 4 and the recording paper 10 superposed at the head position Ph, while the recording paper 10 and the ink ribbon 4 are moved in the directions of arrows B and C, respectively, an image of yellow is formed on the recording paper 10 by the head 3.

When the image forming for yellow is completed, as shown in FIG. 2B, the recording paper 10 is fed in the direction of the arrow A again. As a result, the positional relationship of the head 3 and the recording paper 10 is as shown in FIG. 2A again. Then, the front end of the next ink area of magenta and the front end of the image forming area on the recording paper 10 are registered with the head position Ph, and the image forming for magenta is performed. As may be understood from the foregoing, images of yellow, magenta, cyan, and an overcoat are formed on the recording paper 10 which is moved reciprocally in the lateral direction of the drawing. Thereafter, the recording paper 10 is fed in the direction of the arrow A, is cut out by the recording paper cutter 5 at the rear end of the image, and is discharged.

The ink ribbon 4 is fed in the direction of the arrow C when it is wound around the winding ribbon roller 4B, and fed in the direction of an arrow D when it is rewound by the feeding ribbon roller 4A. The directions of the arrows C and D respectively correspond to the winding and rewinding directions. Regarding the ink ribbon 4, the direction C, in which the ink ribbon 4 moves from the feeding ribbon roller 4A toward the winding ribbon roller 4B, corresponds to the direction from the upstream to the downstream. This is opposite to the direction of the arrow A, in which the recording paper 10 is moved to pass through the head 3 and the platen roller 9 and is discharged via the discharge path 13.

The printer 1 is provided with a ribbon sensor 8 for detecting a border between the ink areas of the ink ribbon 4 on which yellow ink, magenta ink, cyan ink and an overcoat are applied successively, on the downstream side of the head 3 in the winding direction of the ink ribbon 4. The ribbon sensor 8 is an example of a detection unit to detect a border between the transfer material areas. The ribbon sensor detects a border between an area and the subsequent area, when the printing of a corresponding color is completed and the ink ribbon 4 is further wound. Hereinafter, the respective ink areas and the overcoat area (an example of the transfer material areas) will be referred to as a "panel", and a border between the panels will be referred to as a "panel border". Further, the position Ps (detection position) on the feeding path of the ink ribbon 4 where the ribbon sensor 8 is provided will be referred to as a "sensor position Ps".

The ribbon sensor may be arranged in any position as long as it can detect panel borders. For example, the ribbon sensor may be arranged on the upstream side of the head 3 in the winding direction of the ink ribbon 4.

In the printer 1, a transmission-type color sensor is used as the ribbon sensor 8. The transmission-type color sensor includes a transmitter-side ribbon sensor and a receiver-side ribbon sensor, which are provided on opposite sides of the feeding path of the ink ribbon 4 and are opposed to each other. The positions of the transmitter-side ribbon sensor and the receiver-side ribbon sensor may be replaced by one another.

Either one or both of the ribbon rollers 4A and 4B include an encoder (or encoders) (not shown) which detects the displacement of the ink ribbon 4. The ink ribbon driver 34 calculates the amount of feeding necessary to align the front end of each panel with the head position Ph of the head 3, based on the pulse number of the encoder, the winding diameter of either one or both of the ribbon rollers 4A, 4B, and the detection result of the ribbon sensor 8, etc. The ink ribbon driver 34 feeds the ink ribbon 4 in accordance with the calculated amount of feeding, to align the front end of each panel with the head position Ph.

The length of an image which can be formed on the recording paper 10 depends on the lengths of the respective color ink areas of the ink ribbon 4. When an image corresponding to a photograph of, for example, L-size (89×127 mm) or 2L-size (127×178 mm) is formed, the printer 1 uses the ink ribbon 4 having the length corresponding to L-size or 2L-size. However, the printer 1 can also form an image having a shorter length than the length corresponding to the ink ribbon 4. For example, if an ink ribbon for 2L-size is used, the printer can form an image of L-size, as well as the image of 2L-size.

As mentioned above, the printer 1 can print an image whose size is smaller than the size of each panel of the ink ribbon 4. In the following discussion, it is assumed that an image whose size is, for example, 6×8 inches or one-half thereof, i.e., 6×4 inches (152×101 mm) is formed by using an ink ribbon 4 whose panel size is equal to 6×8 inches (152×203 mm). However, the sizes are not limited to the above, and the following example of operation can be applied to a pair of area sizes which differ from one another by more than two times. For example, the pair of sizes may be A5 size (148×210 mm) and A6 size (105×148 mm), or 2L size (127×178 mm) and L-size (89×127 mm), etc. Hereinafter, the size of 6×8 inches will be referred to as "6×8 size", and the size of 6×4 inches will be referred to as "6×4 size". The 6×8 size is an example of the first size, and the 6×4 size is an example of the second size which is not more than one-half of the first size.

An example of the operation of the printer 1 will be discussed below. When an image whose size is not more than one-half of the size of each panel has been formed, the printer 1 stores, inside thereof, information indicating that there are half-unused panels, and determines whether or not the half-unused panels should be used for next printing, based on the data indicating the aforementioned information and the size of the image to be printed next. If the next image can be formed by using the half-unused panels, the printer 1 rewinds the ink ribbon by using the ink ribbon rewinding mechanism, and performs printing with the half-unused panels.

The information indicating whether or not there are half-unused panels may be stored in the memory of the host computer from which image data is received, or may be stored based on the stop position of the ink ribbon 4. In the latter case, the ribbon sensor 8 detects the color of the panel located at the sensor position Ps when the ink ribbon 4 is stopped, and the control unit 30 judges whether or not there are half-unused panels in the ink ribbon 4, based on the detected panel color. For example, if the ribbon sensor 8 detects yellow when the ink ribbon 4 is stopped, the control unit 30 judges that there is no half-unused panel, and if the ribbon sensor 8 detects a color other than yellow (for example, cyan or magenta), the control unit 30 judges that there are half-unused panels.

Further, the control unit 30 judges whether or not the half-unused panels of the ink ribbon 4, if any, can be used to form the next image, based on the detection result of the ribbon sensor 8 and the size of the image to be printed next, received from the host computer.

When the next image data is received, and the control unit 30 judges that the half-unused panels can be reused, the ink ribbon driver 34 rewinds the ink ribbon 4 by using the rewinding mechanism until the front end of the unused portion of the half-unused yellow panel reaches the head position Ph. The head 3 then forms the next image on the recording paper 10 by using the unused portion. On the other hand, if the control unit 30 judges that the half-unused panels cannot be reused, the ink ribbon driver 34 moves the ink ribbon to register the front end of a new yellow panel with the head position Ph. The head 3 then forms the next image on the recording paper 10 by using the new panels.

When a subsequent image is formed by reusing half-unused panels, the panel border between the used portion of a panel which has been used to form an image and whose ink has been exhausted and the unused portion of the next panel may be detected. For example, if the rear halves of panels in the winding direction (forward direction) of the ink ribbon 4 have been used in the previous image forming, and the front halves of the panels are to be used for forming a new image, it is necessary to detect the panel border between the used rear half of one panel and the unused front half of the next panel. However, in such a case, the detection level by the ribbon sensor 8 is not stable when the used rear half passes through the sensor position Ps, thus, erroneous detection of the panel border at which the panels change from the used portion to the unused portion may occur.

Figure 3A:
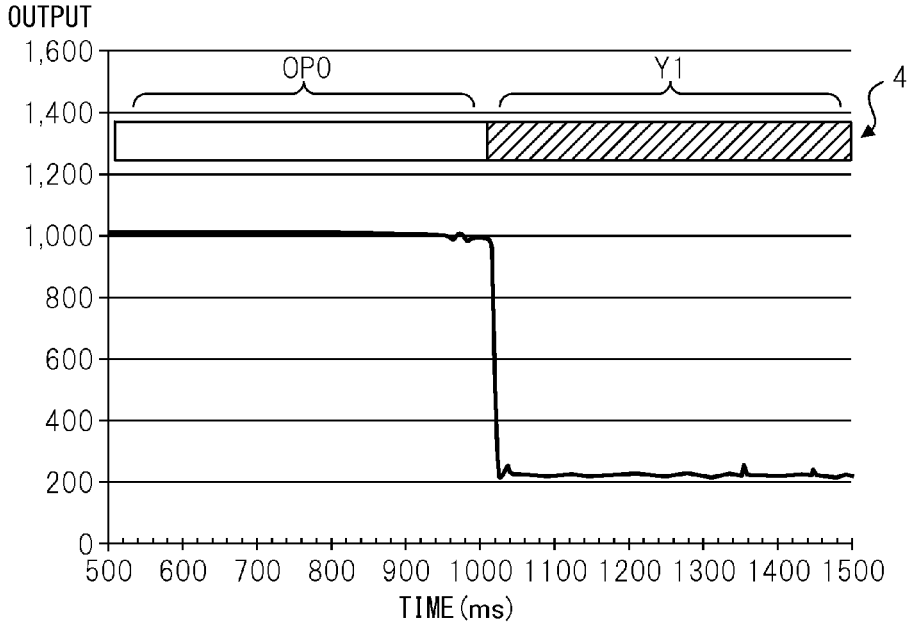
FIGS. 3A and 3B illustrate output waveforms of the ribbon sensor 8.
Figure 3B:
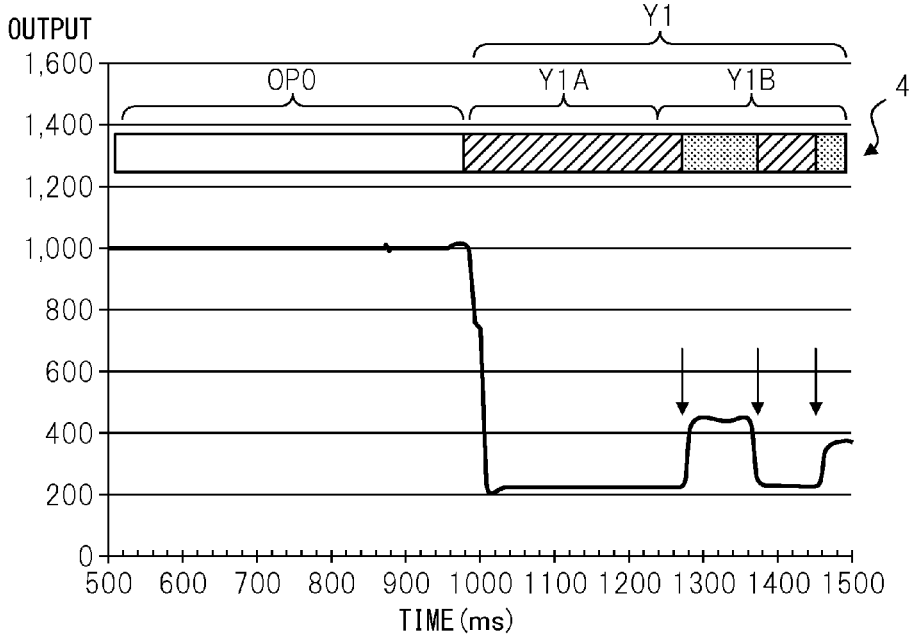

FIGS. 3A and 3B illustrate output waveforms of the ribbon sensor 8. In the respective figures, the output waveforms are correlated with the position on the ink ribbon 4 corresponding to the respective output values.

FIG. 3A shows an output waveform when the panels of unused overcoat OP0 and yellow Y1 pass the sensor position Ps. The output value significantly decreases at the panel border of overcoat OP0 and yellow Y1. However, the output value is substantially constant on the respective panels.

On the other hand, FIG. 3B shows an output waveform when the panels of unused overcoat OP0 and partially used yellow Y1 pass the sensor position Ps. In the panel of yellow Y1, although the front half Y1A in the winding direction is unused, the rear half Y1B has been used and the ink thereof has been partially exhausted. The output waveform of the ribbon sensor 8 for the partially used panel rises and falls as indicated by the arrows, depending on the printed image. Therefore, upon detecting the panel border between yellow Y1 and the subsequent magenta (not shown), the printer 1 may erroneously detect the rising or falling indicated by the arrows as being the panel border.

Contrary to the above, if the front halves of panels in the winding direction (forward direction) of the ink ribbon 4 have been used in the previous image forming, and the rear halve of the panels are to be used for forming a new image, the ribbon sensor 8 detects the panel border between the unused rear half of one panel and the used front half of the next panel. In this case, the panel border at which the panels change from the unused portion where ink remains to the new color is detected, and accordingly, the possibility of erroneous detection as described above is reduced.

However, if the front halves of panels in the winding direction of the ink ribbon 4 are used first, creases may be generated on the ink ribbon 4 when a new image is formed by using the rear halves of the panels. It is known that fewer creases are generated when the rear halves of panels are used first. Accordingly, when an image whose size is not more than one-half of the panel size is formed, it is preferable that the rear halves be used first, and it is necessary to prevent the aforementioned erroneous detection of the panel border.

To this end, in the printer 1, if printing an image by using unused portions of the partially used ink ribbon 4, in detecting the panel border, the ink ribbon driver 34 winds the ink ribbon 4 until the unused portion of a subsequent panel reaches the sensor position Ps, and thereafter, rewinds the ink ribbon 4. The ribbon sensor 8 detects the panel border in the rewinding process. That is, by feeding the ink ribbon 4 in the forward direction until the panel border passes the sensor position Ps, and thereafter feeding the ink ribbon in the reverse direction, the ribbon sensor 8 detects the panel border which approaches the sensor position Ps from the side where the ink remains. This makes erroneous detection of the panel border occur less frequently, since the detection level of the ribbon sensor 8 is substantially constant in the unused portion of the panel.

Figure 4A:
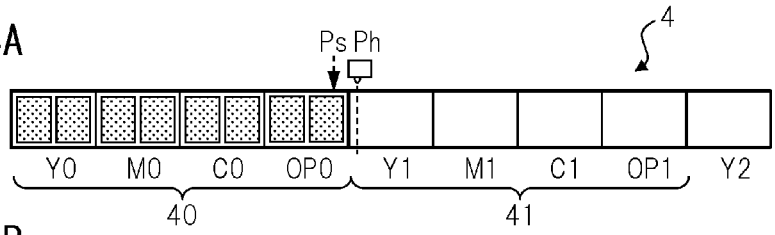
FIGS. 4A to 4G are explanatory views showing the movement of the ink ribbon 4.

FIGS. 4A to 5K are explanatory views showing the movement of the ink ribbon 4. FIG. 4A shows an ink ribbon 4 of a 6×8 size. The area 40 corresponds to the panels which have been entirely used, and the area 41 corresponds to the panels which have not been used at all. The area 40 includes the panels of yellow Y0, magenta M0, cyan C0, and overcoat OP0, and the area 41 includes the panels of yellow Y1, magenta M1, cyan C1, and overcoat OP1. Other panels (not shown) of yellow, magenta, cyan, and overcoat are repeatedly arranged on the areas on the left side of the area 40 and on the right side of the area 41 in this order. FIG. 4A illustrates a state in which the panels up to the area 40 have been entirely used and the panels of the area 41 are ready for printing. The front end of yellow Y1 is positioned at the head position Ph.

Figure 4B:
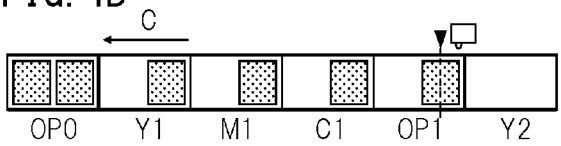

FIG. 4B illustrates a state in which an image of 6×4 size has been formed in accordance with a print command from the host computer, by using the rear halves of the panels of the area 41 in the direction of the arrow C (forward direction, winding direction). Upon printing, the ink ribbon 4 is wound around the winding ribbon roller 4B by the ink ribbon driver 34, and is fed in the direction of the arrow C. The panels of the area 41 which were entirely unused before the printing, become half-unused panels, since the rear halves of the panels of 6×8 size in the winding direction have been used.

Figure 4C:
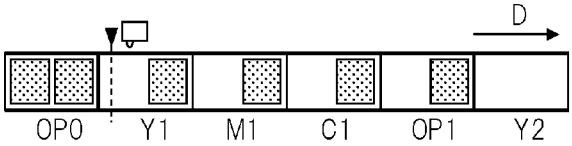

FIG. 4C illustrates a state in which, when there are half-unused panels, data of a 6×4 size image is received from the host computer, and the ink ribbon 4 is rewound until the front half of yellow Y1 whose rear half has been used in the previous image forming reaches the sensor position Ps. In this state, the ink ribbon 4 is fed by the ink ribbon driver 34 in the direction of the arrow D (reverse direction, rewinding direction), toward the feeding ribbon roller 4A.

Figure 4D:
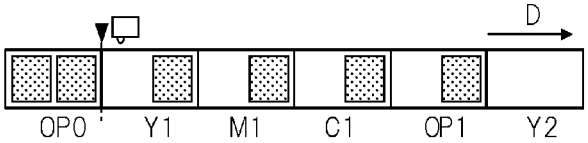

FIG. 4D illustrates a state in which the panel border between overcoat OP0 and yellow Y1 is detected by the ribbon sensor 8, while the ink ribbon 4 is further rewound in the direction of the arrow D. In this state, the ribbon sensor 8 detects, at the sensor position Ps, the panel border at which the panels changes from the unused portion of yellow Y1 to overcoat OP0, and thus, the erroneous detection of the panel border occurs less frequently.

Figure 4E:
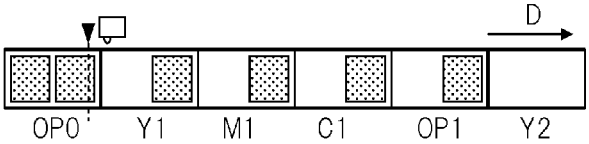

FIG. 4E illustrates a state in which the ink ribbon 4 is further rewound in the direction of the arrow D, until the front end of yellow Y1 reaches the head position Ph. When the panel border between overcoat OP0 and yellow Y1 is detected, the ink ribbon 4 is further rewound by an amount corresponding to the distance between the sensor position Ps and the head position Ph, so that the printing starts at the front end of yellow Y1.

Figure 4F:
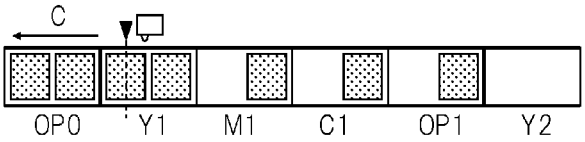

FIG. 4F illustrates a state in which the printing is performed by using the front half of yellow Y1. During the printing, the ink ribbon 4 is wound in the direction of the arrow C.

Figure 4G:
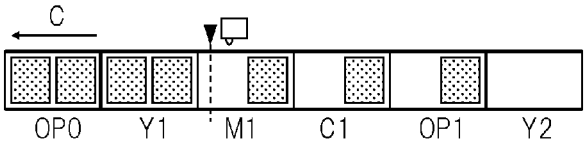

FIG. 4G illustrates a state in which the ink ribbon 4 is rewound in the direction of the arrow C until the unused front half of magenta M1 reaches the sensor position Ps, after the printing using yellow Y1 is performed. As may be seen from the foregoing, when the printing using one panel is completed, the ink ribbon 4 is wound in the direction of the arrow C until the unused portion of the next panel reaches the sensor position.

Figure 5H:
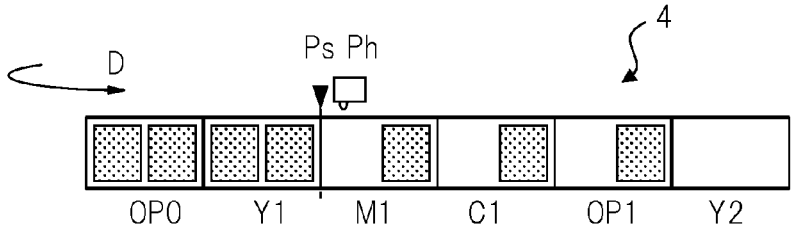
FIGS. 5H to 5K are explanatory views showing the movement of the ink ribbon 4.

FIG. 5H illustrates a state in which the panel border between yellow Y1 and magenta M1 is detected by the ribbon sensor 8, while the ink ribbon 4 is again rewound in the direction of the arrow D. In this state, the ribbon sensor 8 detects, at the sensor position Ps the panel border at which the panels changes from the unused portion of magenta M1 to yellow Y1, and thus, the erroneous detection of the panel border occurs less frequently.

Figure 5I:
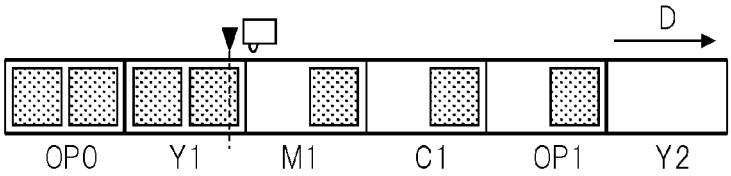

FIG. 5I illustrates a state in which the ink ribbon 4 is further rewound in the direction of the arrow D, until the front end of magenta M1 reaches the head position Ph. When the panel border between yellow Y1 and magenta M1 is detected, the ink ribbon 4 is further rewound by an amount corresponding to the distance between the sensor position Ps and the head position Ph, so that the printing starts at the front end of magenta M1.

Figure 5J:
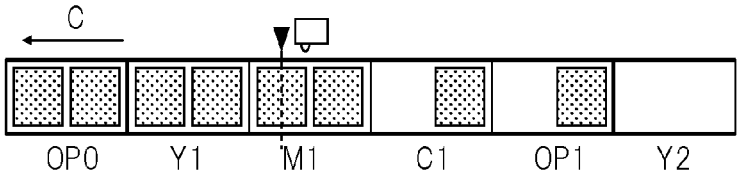

FIG. 5J illustrates a state in which the printing is performed by using the front half of magenta M1. During the printing, the ink ribbon 4 is wound in the direction of the arrow C.

Figure 5K:
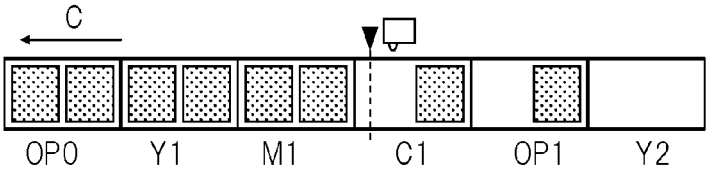

FIG. 5K illustrates a state in which the ink ribbon 4 is rewound in the direction of the arrow C until the unused front half of cyan C1 reaches the sensor position Ps, after the printing using magenta M1 is performed. Thereafter, the detection of the front end of cyan C1 (the panel border between magenta M1 and cyan C1) and the front end of overcoat OP1 (the panel border between cyan C1 and overcoat OP1) is performed in the same way as the detection of the front end of magenta M1 as shown in FIGS. 5H and 5I.

When next printing for 6×8 size or 6×4 size is performed after overcoat OP1 is printed, thus resulting in the completion of the 6×4 size printing, the front end of yellow Y2 (the panel border between overcoat OP1 and yellow Y2) is successively detected. This detection may be performed in the same way as the detection of the front end of magenta M1 as shown in FIGS. 5H and 5I, since the rear half of overcoat OP1 has been used and the front half of yellow Y2 remains unused.

Figure 6:
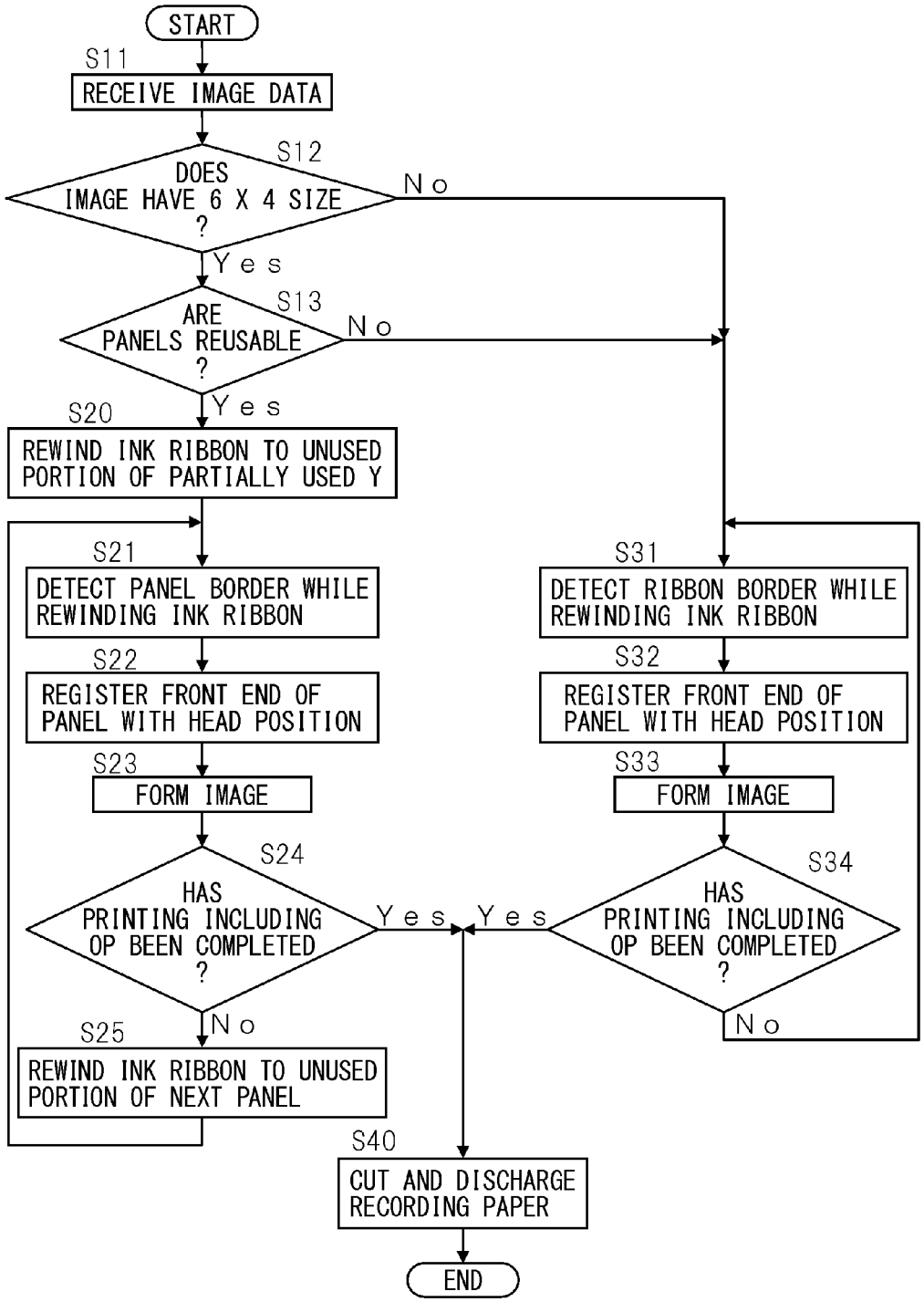
FIG. 6 is a flow chart showing an example of the operation of the printer 1.

FIG. 6 is a flow chart showing an example of the operation of the printer 1. The steps shown in FIG. 6 are executed by the CPU in the control unit 30, in accordance with a program preliminarily stored in the ROM in the control unit 30. Assume that an ink ribbon 4 of 6×8 size is set in the printer 1.

First, the printer 1 receives a print command and image data of an image to be printed from the host computer (S11). Then, the control unit 30 judges whether or not the image data correspond to a 6×4 size image (S12). If the image data corresponds to, for example, a 6×8 size image, other than a 6×4 size image (No in S12), the process proceeds to S31, which will be discussed later, and the head 3 forms the image on the recording paper 10 by using the entirety of panels of 6×8 size. If the image data represents an image larger than the panels of 6×8 size, error processing is performed (not shown).

If the image data corresponds to a 6×4 size image (Yes in S12), the control unit 30 judges whether or not the panels used in the previous image forming can be reused, with reference to the information which indicates whether or not there are half-unused panels and which are retained in the printer (S13). If the control unit 30 judges that the panels cannot be reused (No in S13), the process proceeds to S31, which will be discussed later, and the head 3 forms the image of 6×4 size on the recording paper 10 by using the new panels.

On the other hand, if the control unit 30 judges that the panels can be reused (Yes in S13), since there are panels whose front halves in the winding direction have not been used as shown in FIG. 4B, the ink ribbon driver 34 rewinds the ink ribbon 4 until the unused front half of the panel of yellow Y reaches the sensor position Ps, as shown in FIG. 4C (S20). For this purpose, the ink ribbon driver 34 calculates the necessary amount of feeding based on the pitch of the panels, the pulse number of the encoder, the winding diameters of the ribbon rollers 4A, 4B, etc., and rewinds the ink ribbon 4 in the direction of the arrow D in accordance with the calculated amount of feeding.

Subsequently, as shown in FIG. 4D, the ribbon sensor 8 detects the panel border (initially, the panel border between overcoat OP and yellow Y), while the ink ribbon driver 34 further rewinds the ink ribbon 4 in the direction of the arrow D (S21).

As shown in FIG. 4E, the ink ribbon driver 34 further feeds the ink ribbon 4 by an amount corresponding to the distance between the sensor position Ps and the head position Ph, until the front end of yellow Y reaches the head position Ph (S22). Since the ribbon sensor 8 is provided on the downstream side of the head 3 in the winding direction in the printer 1, the ink ribbon 4 is rewound in the direction of the arrow D. If the ribbon sensor 8 is provided on the upstream side of the head 3 in the winding direction, the ink ribbon 4 is wound in the direction of the arrow C.

After the front end of the panel is aligned as described above, the head 3 forms an image as shown in FIG. 4F by using one panel (yellow Y at first) (S23). Specifically, the recording paper driver 32 feeds the recording paper 10 in accordance with the size of the image forming area on the recording paper 10. Moreover, the head driver 33 moves the head 3 to press the head against the platen roller 9. While the recording paper driver 32 rewinds the recording paper 10, the head 3 forms an image of one color (yellow Y at first). At the same time, the ink ribbon driver 34 moves the ink ribbon 4. The rewinding of the recording paper 10, the winding of the ink ribbon 4, and the image forming by the head 3 are synchronously performed. After the image forming for one color is completed, the head driver 33 moves the head 3 away from the platen roller 9.

Thereafter, the control unit 30 judges whether or not the printing including overcoat OP is completed (S24). If the printing including overcoat OP has not been completed yet (No in S24), the ink ribbon driver 34 winds the ink ribbon 4 until the unused front half of the panel of the next color (the second is magenta M) reaches the sensor position Ps, as shown in FIG. 4G (S25).

The process then returns to S21, and the panel border detection and the image forming are performed for magenta M, cyan C, and overcoat OP, in the same way as yellow Y. Thus, the printer 1 forms respective color images of yellow Y, magenta M, and cyan C on the same image forming area of the recording paper 10, and applies the overcoat layer to form a protection layer. After the printing including overcoat OP is completed (Yes in S24), the process proceeds to S40. After the printing, the ink ribbon driver 34 moves the ink ribbon 4 to register the front end of the subsequent yellow Y with the sensor position Ps and stops the ink ribbon at the registered position.

On the other hand, if the data of the image to be printed does not correspond to a 6×4 size image (No in S12), or if it corresponds to a 6×4 size image but the control unit 30 judges that the panels used in the previous image forming cannot be reused (No in S13), the image forming is performed by using new panels. This corresponds to the case where the next image is too large to be formed in the unused portions (in this example, 6×8 size), or the case where there is no half-unused panel although the size of the image fits the unused portions.

In this case, while the ink ribbon driver 34 winds the ink ribbon 4 in the direction of the arrow C, the ribbon sensor 8 detects the panel border (the panel border between overcoat OP and yellow Y, at first) (S31). If the front end of yellow is originally positioned at the sensor position Ps, no movement of the ink ribbon occurs.

Next, in the same way as in S22, the ink ribbon driver 34 feeds the ink ribbon 4 by an amount corresponding to the distance between the sensor position Ps and the head position Ph until the front end of yellow Y reaches the head position Ph (S32). After the position of the front end of the panel is aligned as described above, the head 3 forms an image by using one panel in the same way as in S23 (S33). Thereafter, the control unit 30 judges whether or not the printing including overcoat OP is completed (S34). If the printing including overcoat OP has not been completed yet (No in S34), the process returns to S31, and if the printing including overcoat OP has been completed (Yes in S34), the process proceeds to S40.

When an image of 6×4 size is printed by using new panels, the half of each of the used panels remains unused, and accordingly, the control unit 30 stores this information in the printer 1. Alternatively, in order to indicate the fact that there are half-unused panels by the stop position of the ink ribbon 4, the ink ribbon driver 34 may rewind the ink ribbon 4 until the panel of, for example, cyan reaches the sensor position Ps, and stop the ink ribbon 4 at a different position from the usual stop position when the printing has been completed.

After the completion of the printing, the recording paper 10 is fed by the recording paper driver 32, cut by the recording paper cutter 5, and discharged from the discharge outlet 6 (S40). Thus, the operation of the printer 1 ends.

As has been explained above, in the printer 1, when unused portions of the partially used ink ribbon 4 are used for printing, by feeding the ink ribbon 4 in the forward direction until an unused portion of a subsequent panel adjacent to a used portion of one panel reaches the sensor position Ps, and thereafter feeding the ink ribbon in the reverse direction, the ribbon sensor 8 detects the panel border between the used portion and the unused portion, the panel border approaching the sensor position Ps from the side where the ink remains. With such a detection method, in the printer 1, erroneous detection of the panel border occurs less frequently.

REFERENCE SIGNS LIST

1 printer
2 rolled paper holder
3 head
4 ink ribbon
4A feeding ribbon roller
4B winding ribbon roller
8 ribbon sensor
9 platen roller
10 recording paper
30 control unit
Ph head position
Ps sensor position

What is claimed is:

1. An image forming device comprising:

a feeding unit to feed a strip-shaped transfer medium on which a plurality of transfer material areas each having a first size and respectively corresponding to a plurality of transfer materials are repeatedly arranged in a predetermined sequence in the longitudinal direction of the transfer medium;

an image forming unit to form an image having the first size or a second size which is not more than one-half of the first size on a recording medium by transferring the transfer materials respectively for the transfer material areas;

a detection unit to detect a border between the transfer material areas based on a change of colors of the transfer material areas which are fed by the feeding unit and pass through a detection position; and a control unit to control the feeding unit when a second image of the second size is newly formed by the image forming unit by using unused portions respectively included in transfer material areas which have been partially used to form a first image of the second size, so that, for each of the partially used transfer material areas, the feeding unit feeds the transfer medium in a forward direction until a used portion of the partially used transfer material area passes through the detection position and an unused portion of the next transfer material area reaches the detection position, and thereafter feeds the transfer medium in the reverse direction, allowing the detection unit to detect a border between the used portion and the unused portion from the unused portion side.

2. The image forming device according to claim 1, wherein when an image of the second size is formed by using unused transfer material areas, the image forming unit uses rear halves of the respective transfer material areas in the forward direction, and the used portion is the rear half of the transfer material area in the forward direction, and the unused portion is the front half of the transfer material area in the forward direction.

3. An image forming method to form an image having a first size or a second size which is not more than one-half of the first size on a recording medium by transferring a plurality of transfer materials respectively for a plurality of transfer material areas, while feeding a strip-shaped transfer medium on which the transfer material areas each having the first size and respectively corresponding to the transfer materials are repeatedly arranged in a predetermined sequence in the longitudinal direction of the transfer medium, the method comprising the steps of:

detecting a border between the transfer material areas based on a change of colors of the transfer material areas which are fed and pass through a detection position; and controlling the transfer medium to be fed in a forward direction until a used portion of the partially used transfer material area passes through the detection position and an unused portion of the next transfer material area reaches the detection position, and thereafter fed in the reverse direction, so that, for each of partially used transfer material areas, a border between the used portion and the unused portion is detected from the unused portion side, when a second image of the second size is newly formed by using unused portions respectively included in transfer material areas which have been partially used to form a first image of the second size.

* * * * *